US007396421B2

(12) United States Patent
Omura et al.

(10) Patent No.: US 7,396,421 B2
(45) Date of Patent: Jul. 8, 2008

(54) DUPLEX STAINLESS STEEL AND MANUFACTURING METHOD THEREOF

(75) Inventors: Tomohiko Omura, Kishiwada (JP); Satoshi Matsumoto, Hirakata (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 465 days.

(21) Appl. No.: 11/135,448

(22) Filed: May 24, 2005

(65) Prior Publication Data

US 2005/0211344 A1 Sep. 29, 2005

Related U.S. Application Data

(63) Continuation of application No. PCT/JP2004/011070, filed on Aug. 3, 2004.

(30) Foreign Application Priority Data

Aug. 7, 2003 (JP) ..... 2003-289418

(51) Int. Cl.

| | |
|---|---|
| ***C22C 38/22*** | (2006.01) |
| ***C21C 7/06*** | (2006.01) |
| ***C21C 7/064*** | (2006.01) |
| ***C21C 7/076*** | (2006.01) |
| ***C21D 8/00*** | (2006.01) |

(52) U.S. Cl. ..... 148/325; 148/327; 148/542; 148/546; 148/593; 148/606; 148/609; 148/610; 75/584; 75/568; 75/560

(58) Field of Classification Search ..... 148/325, 148/327.542, 546, 593, 606, 609, 610; 420/46, 420/56–59; 75/470, 560, 568, 584
See application file for complete search history.

(56) References Cited

U.S. PATENT DOCUMENTS 5,849,111 A 12/1998 Igarashi et al.
6,048,413 A 4/2000 Park et al.

FOREIGN PATENT DOCUMENTS

EP 0 545 753 A1 6/1993

(Continued)

OTHER PUBLICATIONS

Introduction To Steels and Cast Irons, p. 3, Table 1.1, 1985.*

(Continued)

*Primary Examiner*—Deborah Yee
(74) *Attorney, Agent, or Firm*—Clark & Brody

(57) ABSTRACT

A duplex stainless steel containing C, Si, Mn, P, S, Al, Ni, Cr, Mo, N (nitrogen, O (oxygen), Ca, Mg, Cu, B, and W, and the balance Fe and impurities, where a number of oxide-based inclusions, which have a total content of Ca and Mg of 20 to 40% by mass and also have a long diameter of not less than 7 μm, is not more than a 10 per 1 $mm^2$ of the cross section perpendicular to the working direction, or further, the number of oxide-based inclusions, which have a content of S of not less than 15% by mass and also have a long diameter of not less than 1 μm, is not more than 10 per 0.1 $mm^2$ of the cross section perpendicular to the working direction. Particularly, the contents of Cu, B and W are desirably 0.2 to 2%, 0.001 to 0.01%, and 0.1 to 4% by mass, respectively.

17 Claims, 2 Drawing Sheets

FOREIGN PATENT DOCUMENTS

| | | | |
|---|---|---|---|
| EP | 0 757 112 A1 | | 2/1997 |
| JP | 401309919 | * | 12/1989 |
| JP | 05-132741 | | 5/1993 |
| JP | 07-278755 | | 10/1995 |
| JP | 08-170153 | | 7/1996 |
| JP | 10-060526 | | 3/1998 |
| JP | 10-060598 | | 3/1998 |
| JP | 11-071655 | * | 3/1999 |
| JP | 11-293412 | | 10/1999 |
| JP | 3127822 | | 11/2000 |
| JP | 2001-220652 | | 8/2001 |
| JP | 2001-262287 | * | 9/2001 |
| JP | 2002-194505 | * | 7/2002 |
| JP | 2002-241838 | | 8/2002 |
| JP | 2003-147489 | | 5/2003 |
| JP | 2003-160839 | | 6/2003 |
| WO | WO 03/044237 A1 | | 5/2003 |

OTHER PUBLICATIONS

J.E. Castle and Ruoru Ke, "Studies by Auger Spectroscopy of PIT Initiation at the Site of Inclusions in Stainless Steel", Corrosion Science, vol. 30, No. 4/5, pp. 409-428, CP. 1990.

* cited by examiner

DUPLEX STAINLESS STEEL AND MANUFACTURING METHOD THEREOF

This application is a continuation of International Patent Application No. PCT/JP2004/011070 filed Aug. 3, 2004. This PCT application was not in English as published under PCT Article 21(2).

The disclosure of Japan Patent Application No. 2003-289418 filed Aug. 7$^{th}$, 2003 including specification, drawings and claims is incorporated herein by reference in its entirety.

FIELD OF THE INVENTION

The present invention relates to duplex stainless steel which is excellent in corrosion resistance in seawater. This steel is used for steel pipes, steel plates or the like, such as piping for heat exchange, piping or structures for a chemical plant, line pipes, oil well or gas well casing or tubing, and umbilical tubes (control piping for a submarine oil field).

BACKGROUND OF THE INVENTION

Conventionally, although crude oil and natural gas drilled from submarine oil fields and the like have been shunned because of severe working environments, the recent tight energy conditions bring about a situation in which the crude oil and natural gas must be utilized. Therefore, the demand for stainless steel which is excellent in pitting resistance, particularly duplex stainless steel, is increasing as a material for steel pipes or other structures used in seawater.

A so-called super duplex stainless steel which is enhanced in pitting resistance because it contains W in addition to the adjustment of the contents of Cr, Mo and N (nitrogen), which are generally effective for improving the pitting resistance of duplex stainless steel, is disclosed in Patent Document 1. It suggests that an index, showing the pitting resistance of duplex stainless steel, PREW of the following equation (B) containing W, in addition to PRE (pitting resistance equivalent) of the following equation (A).

The pitting resistance index PRE or PREW is adjusted to not less than 35 in the general duplex stainless steel and to not less than 40 in the super duplex stainless steel. Conventional techniques for improving the pitting resistance were performed based on how much the pitting resistance index PRE or PREW can be increased.

$$PRE=Cr+3.3Mo+16N\ (\text{nitrogen}) \quad (A)$$

$$PREW=Cr+3.3(Mo+0.5W)+16N\ (\text{nitrogen}) \quad (B)$$

In the equations (A) and (B), each chemical symbol shows the content of each element (% by mass).

The influence on the pitting resistance of non-metallic inclusions has not been examined in the duplex stainless steel. However, with respect to the pitting resistance of austenitic stainless steel, it is known that Mn sulfides are most harmful to the pitting resistance, and oxides thereof are harmless as described in Non-Patent Document 1.

Oxide-based inclusions contained in stainless steels are generally composite oxides composed of oxides such as Al oxide ($Al_2O_3$), Si oxide ($SiO_2$), Cr oxide ($Cr_2O_3$). These oxides were assumed to have no influence on pitting because they hardly dissolve in aqueous solutions or so-called insolubility. On the other hand, although Ca and Mg, and further S which are impurity elements in steel product, might be contained in the oxides, the influence of these elements on the pitting resistance have been never examined.

[Patent Document 1] Japanese Patent Laid-Open No. H05-132741

[Non-Patent Document 1] J. E. Castle et al., "Studies by Auger Spectroscopy of Pit Initiation at the site of Inclusions in Stainless Steel", Corrosion Science, Volume 30, No. 4/5, p. 409

SUMMARY OF THE INVENTION

In recent years, application of duplex stainless steel to severe corrosive environments such as a high-temperature seawater environment has increased. For example in a corrosion test simulating such a severe condition, an 80° C.-ferric chloride test, sufficient pitting resistance cannot be necessarily obtained even in case of super duplex stainless. Only the adjustment of the contents of Cr, Mo and N (nitrogen) and further W or the like, is often insufficient for the improvement in pitting resistance. Further, although the pitting resistance can be somewhat improved by reducing the Mn sulfides in the steel, even in duplex stainless steel similar to the austenitic stainless steel, the pitting cannot be absolutely prevented.

The present invention solves these problems, and it's objective is to provide a duplex stainless steel capable of stably obtaining satisfactory pitting resistance, and a method for producing the same.

As a result of detailed examinations for metallurgical factors affecting the pitting resistance of duplex stainless steel, the present inventors found that, in addition to the above-mentioned conventional factor contributing to pitting, even the oxide-based inclusions generated in the steel-making process can significantly affect the pitting resistance, if they contain Ca and Mg, and also if they contain S. The knowledge obtained by the studies by the present inventors is as follows.

Oxide-based inclusions formed in steel with a Ca-content of less than 0.0005% by mass or a Mg-content of less than 0.0001% by mass are mainly composed of insoluble $Al_2O_3$, and never cause pitting. Oxide-based inclusions formed with a Ca or Mg content exceeding 0.005% by mass are mainly composed of (Ca,Mg)O, and pitting hardly commences in such oxides.

However, oxide-based inclusions formed in steel with a Ca-content of 0.0005 to 0.005% by mass and a Mg-content of 0.0001 to 0.005% by mass produce a state where $Al_2O_3$ and (Ca,Mg)O are coexistent, and when these oxide-based inclusions are formed adjacently, pitting is apt to commence in such oxides.

As a result of various studies in order to clarify the cause of pitting in duplex stainless steel containing 0.0005 to 0.005% by mass of Ca and 0.0001 to 0.005% by mass of Mg, the present inventors found that the occurrence of pitting depends on the size and number of oxide inclusions formed in the steel.

S is an element inevitably present in steel, and it is impossible to entirely remove the content in present steel-making techniques. Although S deteriorates the pitting resistance when contained in the oxide-based inclusions formed in steel in large quantities, it was made clear by the studies by the present inventors that the pitting can be suppressed, even in such oxide-based inclusions, by adjusting the size and number thereof.

Duplex stainless steel, of a desired oxide-based inclusion state, cannot be produced by steel-making or thermal treatment using conventional methods. As a result of various examinations, the present inventors found that (α) the slag basicity in reduction, (β) the killing temperature and time in ladle, and (γ) the total working ratio after casting are controlled to an optimum combination, whereby a desired oxide-based inclusion state can be obtained, enabling production of unconventional high clean steel.

The present invention has been completed based on the chemical composition of a steel product which is capable of ensuring the performances of a duplex stainless steel; an oxide-based inclusion state capable of significantly improving the pitting resistance, and a production process for attaining increased cleanness.

The present invention involves duplex stainless steels shown in the following descriptions (a) and (b), and a method for producing duplex stainless steel shown in the following description (c).

(a) A duplex stainless steel containing, by mass %, C: not more than 0.03%, Si: 0.01 to 2%, Mn: 0.1 to 2%, P: not more than 0.05%, S: not more than 0.001%, Al: 0.003 to 0.05%, Ni: 4 to 12%, Cr: 18 to 32%, Mo: 0.2 to 5%, N (nitrogen): 0.05 to 0.4%, O (oxygen): not more than 0.01%, Ca: 0.0005 to 0.005%, Mg: 0.0001 to 0.005%, Cu: 0 to 2%, B: 0 to 0.01%, and W: 0 to 4%, and the balance of Fe and impurities, where a number of oxide-based inclusions, which have a total content of Ca and Mg of 20 to 40% by mass and also have a long diameter of not less than 7 μm, is not more than a 10 per 1 $mm^2$ of the cross section perpendicular to the working direction.

(b) A duplex stainless steel containing, by mass %, C: not more than 0.03%, Si: 0.01 to 2%, Mn: 0.1 to 2%, P: not more than 0.05%, S: not more than 0.001%, Al: 0.003 to 0.05%, Ni: 4 to 12%, Cr: 18 to 32%, Mo: 0.2 to 5%, N (nitrogen): 0.05 to 0.4%, O (oxygen): not more than 0.01%, Ca: 0.0005 to 0.005%, Mg: 0.0001 to 0.005%, Cu: 0 to 2%, B: 0 to 0.01%, and W: 0 to 4%, and the balance of Fe and impurities, where a number of oxide-based inclusions, which have a total content of Ca and Mg of 20 to 40% by mass and also have a long diameter of not less than 7 μm, is not more than a 10 per 1 $mm^2$ of the cross section perpendicular to the working direction, and a number of oxide-based inclusions, which have a content of S of not less than 15% by mass and also have a long diameter of not less than 1 μm, is not more than 10 per 0.1 $mm^2$ of the cross section perpendicular to the working direction.

In the steels described in the above (a) and (b), the contents of Cu, B and W are desirably 0.2 to 2%, 0.001 to 0.01% and 0.1 to 4% by mass, respectively. The pitting resistance index PREW, represented by the following equation (1), is desirably not less than 40. In the equation (1), each chemical symbol shows the content of each element (% by mass).

$$PREW=Cr+3.3(Mo+0.5W)+16N \quad (1)$$

(c) A method for producing a duplex stainless steel, according to the above-mentioned (a) or (b), characterized by reducing the condition that a slag basicity, represented by the following equation (2) is 0.5 to 3.0, killing to tapped molten steel at the temperature not lower than 1500° C. for not less than 5 minutes followed by casting, and forming the resulting bloom on the condition that the total working ratio R represented by the following equation (3), is not less than 10. In the equation (2), each compound represents the concentration in slag (% by mass) of each compound. In the equation (3), $A0_n$ and $A_n$ represent a cross sectional area before the deformation in the plastic deformation process and a cross sectional area after the deformation in the plastic deformation process, respectively, and each subscript n (1, 2, . . . i) represents each stand order in the plastic deformation process.

$$[\text{Slag Basicity}] = (CaO + MgO)/(Al_2O_3 + SiO_2) \quad (2)$$

$$[\text{Total working ratio } R] = \prod_{n=1}^{i}\left(\frac{A0_n}{A_n}\right) \quad (3)$$

According to the present invention, duplex stainless steel having good pitting resistance can be stably obtained. Therefore, duplex stainless steel most suitable for steel pipes, steel plates or the like, such as piping for heat exchange, piping or structures for chemical plant, line pipes, oil well or gas well casing or tubing, or umbilical tubes (control piping for submarine oil field) can be provided.

(Explanation of Numerals)

1: steel plate (or steel pipe)

DETAILED DESCRIPTION OF THE INVENTION

1. Chemical Composition

Figure 1:
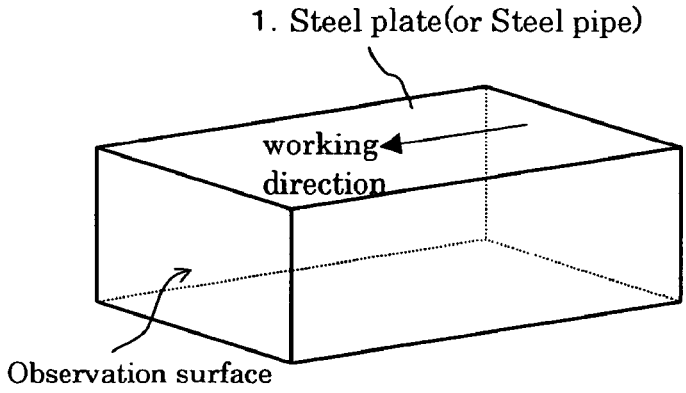
FIG. 1 is a view showing an observation surface for oxide-based inclusions.

It is required to organize the chemical composition of the steel product within the following range in order to ensure sufficient pitting resistance in a duplex stainless steel. In the following descriptions, "%" for content means "% by mass".

C: Not more than 0.03%

C is inevitably present in steel. When the content exceeds 0.03%, carbides are apt to precipitate, resulting in deterioration of pitting resistance. Accordingly, the content of C is set to not more than 0.03%.

Si: 0.01 to 2%

Si is an element effective for deoxidation of steel, and a content of not less than 0.01% is therefor required. However, a content exceeding 2% promotes generation of intermetallic compounds, resulting in deterioration of pitting resistance. Accordingly, the content of Si is set to 0.01 to 2%.

Mn: 0.1 to 2%

Mn is effective for stabilization of austenitic phases similar to Ni, and a content of not less than 0.1% is therefor required. On the other hand, a content exceeding 2% leads to deterioration of pitting resistance. Accordingly, the content of Mn is set to 0.1 to 2%.

P: Not more than 0.05%

P is inevitably present in steel as impurities, and actively dissolves to deteriorate the pitting resistance. Since a content exceeding 0.05% makes this effect remarkable, the content must be set to not more than 0.05%. The content of P is desirably as low as possible.

S: Not more than 0.001%

S is inevitably present in steel similar to P, and deteriorates the pitting resistance by forming sulfides which are easily dissolved. A content exceeding 0.001% makes this effect remarkable. Since even a content of not more than 0.001% can assist pitting when contained in oxide-based inclusions, as described later, the content of S is desirably as low as possible within this range.

Al: 0.003 to 0.05%

Al is an element necessary for deoxidation of steel, and a content of not less than 0.003% is therefor required. On the other hand, an excessive content causes deterioration the pitting resistance because of precipitation of Al nitrides, which absorb N (nitrogen) which is an element effective for improving the pitting resistance. Accordingly the content of Al is set to 0.003 to 0.05%. Al means "sol.Al (acid-soluble Al)".

Ni: 4 to 12%

Ni is an element that stabilizes austenitic phases, and its effect is insufficient within a content of less than 4%. On the other hand, a content exceeding 12% causes excessive austenitic phases, resulting in a loss of mechanical properties in duplex stainless steel. Accordingly, the content is set to 4 to 12%.

Cr: 18 to 32%

Cr is effective for improving the pitting resistance, and a content of less than 18% results in making the pitting resistance insufficient. On the other hand, a content exceeding 32% causes excessive ferritic phases, resulting in a loss of mechanical properties in duplex stainless steel. Accordingly, the content of Cr is set to 18 to 32%

Mo: 0.2 to 5%

Mo is also an element, which can enhance the pitting resistance similarly to Cr, and the effect is not sufficient with a content of less than 0.2%. On the other hand, a content exceeding 5% causes precipitation of intermetallic compounds, inversely resulting in deterioration of the pitting resistance. Accordingly, the content of Mo is set to 0.2 to 5%.

N (Nitrogen): 0.05 to 0.4%

N (Nitrogen) is an element which effects the stabilizing austenitic phases similar to Ni. N (nitrogen) also has the effect of enhancing the pitting resistance similarly to Cr and Mo. However, these effects are insufficient with a content of less than 0.05%. On the other hand, a content exceeding 0.4% causes deterioration of hot workability. Accordingly, the content of N (nitrogen) is set to 0.05 to 0.4%.

O (Oxygen): Not more than 0.01%

O (Oxygen) is inevitably present in steel similar to S; it is present in an oxide-based inclusion state. These oxides deteriorate the pitting resistance depending on their compositions, because these oxides are the origin of pitting. Particularly when the content exceeds 0.01%, coarse oxides increase which makes this tendency remarkable. Accordingly, O (oxygen) must be limited to not more than 0.01%. The content of O (oxygen) is desirably as low as possible.

Ca: 0.0005 to 0.005%, Mg: 0.0001 to 0.005%

Ca and Mg are elements having the effect of improving hot workability of steel by controlling S as sulfides. However, as described above, in duplex stainless steel containing Ca: 0.0005 to 0.005% and Mg: 0.0001 to 0.005%, when $Al_2O_3$ and (Ca,Mg)O are coexistent and formed adjacently, the pitting resistance is adversely affected. Accordingly, the contents of Ca and Mg are limited to ranges of 0.0005 to 0.005% and 0.0001 to 0.005%, respectively, where the pitting resistance is apt to deteriorate. The pitting resistance of the duplex stainless steel of the present invention can be improved by limiting the oxide-based inclusion state as described later.

The duplex stainless steel of the present invention has the above-mentioned chemical composition, with the balance being Fe and impurities. The duplex stainless steel of the present invention may include one or more of Cu, B and W as optional additive elements.

Cu: 0 to 2%

Cu stabilizes the austenitic phase similar to Ni. It also stabilizes sulfide coatings in a hydrogen sulfide environment which improves the pitting resistance. Therefore, Cu may be added as occasion demands. Although a content of not less than 0.2% is desirable to obtain the above effect, a content exceeding 2% deteriorates the hot workability. Accordingly, when Cu is added, the content is desirably set to 0.2 to 2%.

B: 0 to 0.01%

B may be added as occasion demands since it is an element effective for improving the hot workability. Although the content is desirably set to not less than 0.001% in order to obtain this effect, the effect is saturated even if the content exceeds 0.01%. Accordingly, when B is added, the content is desirably set to 0.001 to 0.01%.

W: 0 to 4%

W may be added as occasion demands since it is an element effective for improving the pitting resistance similarly to Cr and Mo. This effect becomes remarkable when the content is not less than 0.1%. However, a content exceeding 4% causes precipitation of intermetallic compounds, which somewhat deteriorates the pitting resistance. Accordingly, when W is added, the content is desirably set to 0.1 to 4%.

2. Pitting Resistance Index

The duplex stainless steel of the present invention is desirably a super duplex stainless steel, having the above-mentioned chemical composition and the pitting resistance index, which is defined as follows, is not less than 40 of. In the equation (1), each chemical symbol represents the content (% by mass) of each element.

$$PREW=Cr+3.3(Mo+0.5W)+16N \quad (1)$$

3. Condition of Oxide-Based Inclusions

The present inventors examined the influence of oxide-based inclusions on the pitting resistance by the following means.

Molten steels having chemical compositions shown in Tables 3 and 4 were worked in various conditions to produce duplex stainless steel pipes 1.4 to 16 (mm) thick. After these steel pipes were flattened, test pieces of pipe thickness×10 mm×10 mm were cut out therefrom. The test pieces were mounted in a resin to the cross-sectional ("observation surface" shown in FIG. 1) direction perpendicular to the working direction of each test piece, and this cross section was finished by polishing. The polish-finished surface was observed by a scanning microscope (SEM) to measure a long diameter and the chemical composition of oxide-based inclusions.

Figure 2:
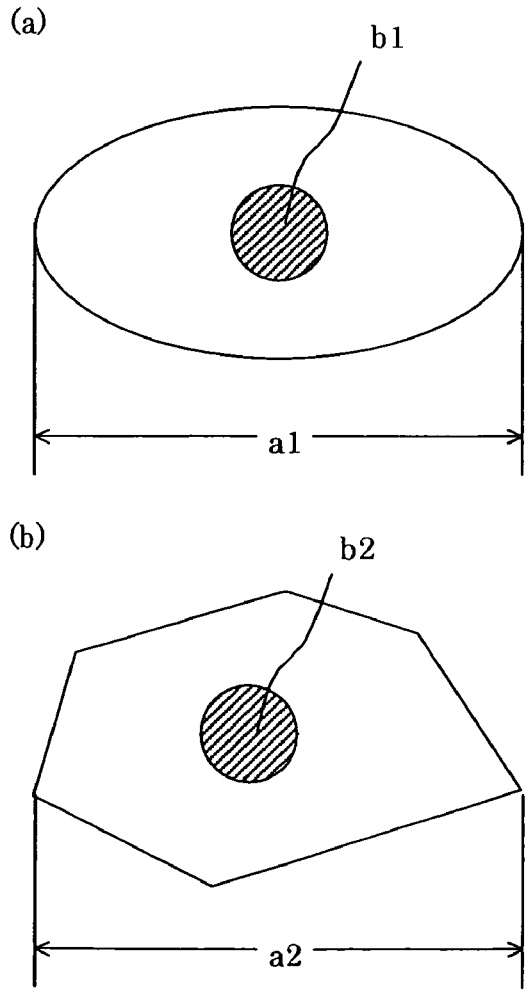
FIG. 2 are views for defining the long diameter and measuring position of composition of oxide-based inclusions.

The long diameter of oxide-based inclusions means the length (a1 or a2) of the longest straight line of the lines connecting two different points on the interface between a base metal and each inclusion as shown in FIG. 2. For the composition of the oxide-based inclusion, the vicinity of the center part of the inclusion (b1 or b2 in the example shown in FIG. 2) or the vicinity of the center-of-gravity part of the cross sectional shape of the inclusion was measured by EDX (energy dispersion X-ray spectroscopy) to determine the contents of alloy elements other than O (oxygen).

After the observation of the oxide-based inclusions, the test pieces were immersed in a 6% aqueous solution of ferric chloride of 80° C. for 6 hours, and the corrosive state of the periphery of the oxide-based inclusions was then observed. As a result, pitting started at the oxide-based inclusions was observed in part of the test pieces. The oxide-based inclusions which caused the pitting are composite oxides of $Al_2O_3$ and (Ca,Mg)O, in which the portion of (Ca,Mg)O preferentially elutes to form gaps with the base metal, and the gaps developed into pitting.

Each of the generated oxide-based inclusions was observed by SEM to examine the relationship of the oxide-based inclusions with the presence/absence of pitting.

Figure 3:
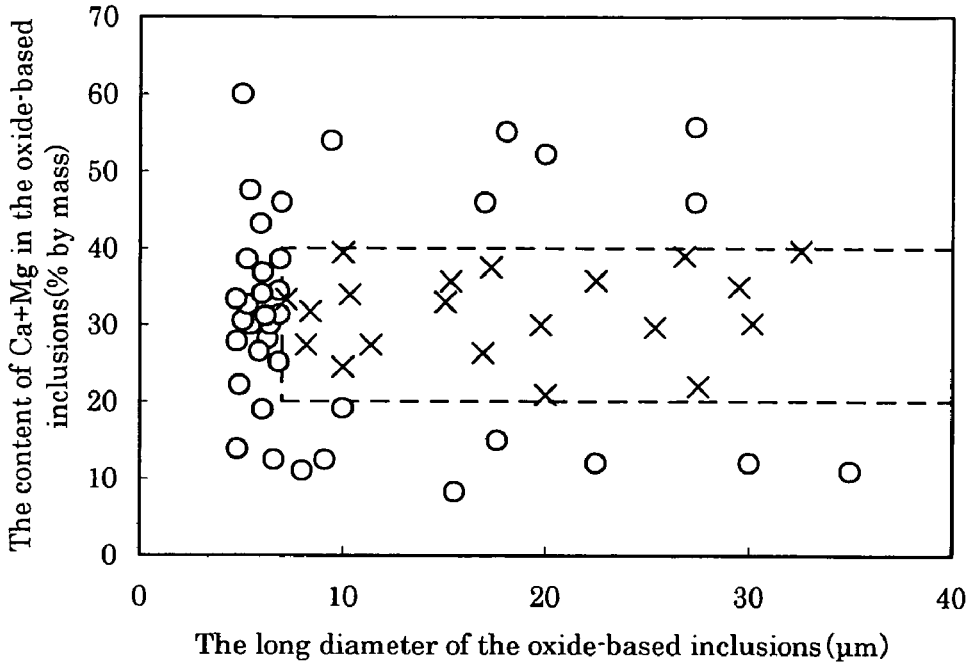
FIG. 3 are views showing the relation between long diameter and total content of Ca and Mg in oxide-based inclusions.

The relation between the long diameter and the total content of Ca and Mg of oxide-based inclusions is shown in FIG. 3, wherein "x" shows an oxide-based inclusion at which pitting started up, and "○" shows an oxide-based inclusion at which no pitting commenced.

As shown in FIG. 3, the pitting began when the oxides, with a total content of Ca and Mg of 20 to 40% and a long diameter of not less than 7 μm. However, the pitting did not begin when the oxides, with a total content of Ca and Mg of less than 20% because the oxides are mainly composed of Al oxides, which were difficult to elute. Although oxides with a total content of Ca and Mg exceeding 40% are absolutely eluted, the gaps did not develop into pitting because the effect of the forming of the gaps, with the base metal, are low. In oxide-based inclusions, with a total content of Ca and Mg of 20 to 40%, but a long diameter less than 7 μm, the gaps did not develop into pitting even by elution of the oxides because the size of the gaps were not sufficient.

Therefore, paying attention to oxide-based inclusions having a total content of Ca and Mg of 20 to 40% and a long diameter of not less than 7 μm, the pitting resistant temperature was checked. The critical pitting temperature means the highest temperature where no pitting is caused, by immersing in a 6% aqueous solution of ferric chloride of 35 to 80° C. with a change in temperature by 5° C. for 24 hours. It was found that, when the number of oxide-based inclusions, having a total content of Ca and Mg of 20 to 40% and a long diameter of not less than 7 μm exceeds 10 per 1 $mm^2$ of the cross section perpendicular to the working direction, the critical pitting temperature is remarkably reduced which results in the corrosion resistance, in the above-mentioned severe corrosive environment, insufficient.

Accordingly, the number of oxide-based inclusions, having a total content of Ca and Mg of 20-40% and a long diameter of not less than 7 μm, is set to not more than 10 per 1 $mm^2$ of the cross section perpendicular to the working direction. For various oxide-based inclusions, the occurrence tendency of pitting was organized similar to the case of the Ca and Mg.

Figure 4:
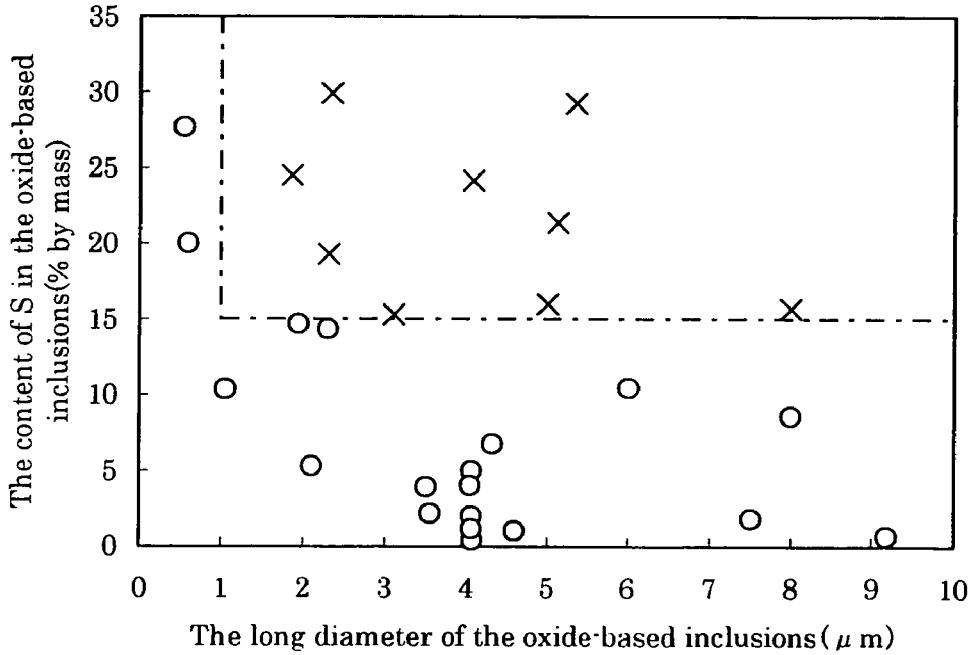
FIG. 4 are views showing the relation between long diameter and a content of S in oxide-based inclusions.

The relationship between long diameter and a content of S of the oxide-based inclusions is shown in FIG. 4, wherein "x" and "○" mean the same as they do in FIG. 3.

As shown in FIG. 4, the pitting began with oxide-based inclusions having a content of S of not less than 15% and a long diameter of not less than 1 μm. Although the oxide-based inclusions containing S perfectly eluted after the pitting test, because of minute size, the hydrogen sulfide generated after the elution promoted corrosion and developed into pitting. On the other hand, oxide-based inclusions with a long diameter of less than 1 μm and oxide-based inclusions with a content of S of less than 15%, did not cause pitting.

Therefore, paying attention to oxide-based inclusions having a content of S of not less than 15% and a long diameter of not less than 1 μm, the same critical pitting temperature as above was therefor examined. As a result, it was found that when the number of these inclusions is not more than 10 per 0.1 $mm^2$ of the cross section perpendicular to the working direction, the pitting resistance is improved.

Accordingly, the number of the oxide-based inclusions having a content of S of not less than 15% and a long diameter of not less than 1 μm is desirably set to not more than 10 per 0.1 $mm^2$ of the cross section perpendicular to the working direction.

4. Method for Producing Duplex Stainless Steel of the Present Invention

The production method for controlling the composition of oxide-based inclusions in duplex stainless steel was examined in detail. As a result, it was found that an unprecedented high cleanliness duplex stainless steel can be obtained, particularly, by optimizing respective production processes of (α) reductive treatment, (β) killing and (γ) working after casting. The respective production processes are described as follows.

(α) Reductive Treatment

The reductive treatment is carried out in a condition providing a slag basicity, represented by the following equation (2), of 0.5 to 3.0. In the equation (2), each compound represents the concentration in slag (% by mass) of each compound.

$$[\text{Slag Basicity}]=(CaO+MgO)/(Al_2O_3+SiO_2) \quad (2)$$

Stainless crude molten steel, obtained by melting a raw material in an electric furnace or the like, is decarburized while blowing oxygen to the molten steel in a secondary refining furnace such as AOD or VOD, and is performed a treatment called reduction which is put a deoxidizing agent, such as metallic aluminum and a desulfurizing agent, such as limestone in order to recover chromium oxidized in the decarburization. In this reductive stage, the oxygen and sulfur bonded to these agents are removed from the molten steel by transferring as $Al_2O_3$, CaS or the like into the slag.

To attain low oxygen and low sulfur which are characteristics of the present invention, the slag basicity represented by the equation (2) must be set to not less than 0.5. Particularly, to minimize the content of S in oxide-based inclusions, the slag basicity is desirably set to not less than 1.0. On the other hand, an excessively high slag basicity makes the oxide-based inclusions with a total content of Ca and Mg of 20 to 40% easy to be left in the steel, resulting in deterioration of pitting resistance of the steel product, and in addition to that, the flowing property becomes deficient, according to a rise of the melting point. From this point of view, it is required to set the upper limit value to 3.0. To sufficiently reduce the Ca-content and Mg-content in the oxide-based inclusions, the slag basicity is desirably set to not more than 2.5.

The reductive treatment at the above-mentioned slag basicity is performed once in general. To further reduce the oxygen and sulfur contents, the reductive stage is desirably repeated twice or more. At this time, the slag generated by the first reductive treatment is discharged out to the secondary refining furnace prior to execution of the second reduction by inclining the furnace and scratching it out of the furnace by use of a proper tool. This operation is important for enhancing the desulfurizing performance in the second reductive stage by removing the slag containing a large quantity of sulfur generated in the first reductive stage.

(β) Killing

The killing after reductive treatment is performed at a temperature of not lower than 1500° C. for 5 minutes or more.

After the reductive treatment shown in (α), the molten steel, which finished the secondary refining by a minute adjustment to a predetermined composition, is tapped to a ladle and casted. The tapped molten steel is stationarily stood or moved to a casting place so as not to mix again with the slag floating on the molten steel prior to casting. This treatment is called killing. During the killing, part of oxides suspended in the molten steel is raised by the specific gravity difference and separately absorbed into the slag. In order to give a desired oxide-based inclusion state to the duplex stainless steel, it is required to raise and separate coarse oxides. There fore it is important to ensure a killing temperature of not lower than 1500° C. and a killing time of not less than 5 minutes. To further promote the floatation of the oxides, a killing temperature of not lower than 1550° C. and a killing time of not less than 10 minutes are desired.

(γ) Working After Casting

The working after casting is performed in a condition which provides a total working ratio R, represented by the following equation (3), of not less than 10. In the equation (3), $A0_n$ and $A_n$ represent a cross sectional area before deformation in a plastic deformation process and a cross sectional area after deformation in the plastic deformation process, respectively, and each subscript n (1, 2, . . . i) represents each stand order in the plastic deformation process.

$$[\text{Total working ratio } R] = \prod_{n=1}^{i}\left(\frac{A0_n}{A_n}\right) \tag{3}$$

The cast blooms are subjected to a hot working such as forging or hot rolling or a cold working such as cold rolling, and then formed into a predetermined product dimension. At this time, the oxide-based inclusions are crushed and fined, according to the working directional deformation of the material by the working. In order to give a desired oxide-based inclusion state to the duplex stainless steel, the total working ratio R from bloom to final product must be set to not less than 10.

The plastic deformation process does not include the cutting process and other working processes involving no rolling and drawing. Accordingly, even if a cutting process is contained in the plastic deformation process, the calculation of the equation (3) is performed without considering the change in the cross-sectional area by this cutting process.

EXAMPLES

Example 1

Each duplex stainless steel having a composition shown in Table 1 (super duplex stainless steel with a pitting resistance index PREW of not less than 40) in which 500 kg was melted in an induction melting furnace, transferred to an AOD furnace, and then refined again therein. At this time, the slag basicity of the reductive stage was set to 2.0. The slag and the molten steel were sampled after the completion of the reductive stage, respectively. The temperature of the molten steel tapped to a ladle was immediately measured by a thermocouple, and the elapsed time up to casting start was measured.

At this time, the ladle is stationary and killed in a given position without producing vibration until it is lifted up by a ladle crane to start casting. The killing condition is shown in Table 2.

TABLE 1

| Chemical composition (% by mass, Balance: Fe and impurities) | | | | | | | | | | | | | | | | |
|---|---|---|---|---|---|---|---|---|---|---|---|---|---|---|---|---|
| C | Si | Mn | P | S | Ni | Cr | Mo | Al | N | O | Ca | Mg | Cu | B | W | PREW* |
| 0.011 | 0.03 | 0.35 | 0.023 | 0.0004 | 6.35 | 25.02 | 2.98 | 0.010 | 0.310 | 0.0030 | 0.0025 | 0.0021 | — | — | 2.01 | 43.13 |

*PREW = Cr + 3.3(Mo + 0.5W) + 16N

TABLE 2

| | | Killing condition | | | | | Critical | |
|---|---|---|---|---|---|---|---|---|
| | | Starting temperature | Treatment time | Number of oxide-based inclusions | | Total working | pitting temperature | |
| | | (° C.) | (min.) | ① | ② | ratio | (° C.) | account |
| Inventive | 1 | 1550 | 5 | 4.3 | 4.4 | 105 | 80 | ◎ |
| Example | 2 | 1500 | 10 | 4.7 | 6.1 | 100 | 80 | ◎ |
| | 3 | 1500 | 5 | 7.3 | 10.1 | 105 | 75 | ○ |
| Comparative | 1 | 1500 | 3 | 11.2 | 11.1 | 105 | 60 | X |
| Example | 2 | 1450 | 10 | 13.3 | 11.9 | 100 | 60 | X |
| | 3 | 1450 | 3 | 17.1 | 18.0 | 105 | 55 | X |

①: The number of oxide-based inclusions which have a total content of Ca and Mg of 20-40% and also have a long diameter of not less than 7 μm per 1 $mm^2$ of the cross section perpendicular to the working direction.
②: The number of oxide-based inclusions which have a contain of S of not less than 15% and also have a long diameter of not less than 1 μm per 0.1 $mm^2$ of the cross section perpendicular to the working direction.

The molten steel was casted into a steel ingot, 160 mm on a side by average dimension, by bottom casting or to a round bloom 180 mm in an outer diameter by continuous casting. The resulting bloom was variously worked by forging, hot extrusion, or cold rolling and formed into a seamless steel pipe 16-280 mm in outer diameter and 1.4 to 16 mm in thickness. The steel pipe was retained at 1100° C. for 3 minutes, and then subjected to solution heat treatment by water-cooling.

After the above tube material was cut and flattened, two test pieces, having a dimension of pipe thickness×10 mm×10 mm each, were cut out. The test pieces were mounted in a resin to the pipe sectional direction, and this cross section was then finished by polishing. Thereafter, the oxide-based inclusions of not less than 7 μm long diameter were observed by SEM for 5 field-of-views each at ×50 magnification, and the oxide-based inclusions of not less than 1 μm long diameter for 5 field-of-views each at ×200 magnification.

The long diameters of the oxide-based inclusions were measured according to the definition of FIG. 2, and the vicinity of the center part of each oxide-based inclusion (b1 or b2 in FIG. 2) was composition-analyzed by EDX (energy dispersive X-ray spectrometry). In the analysis, mass ratios of Al, Ca, Mg, S and Mn except O (oxygen) were measured because the measurement value of O (oxygen) is low in reliability of precision.

The tube material was sectionally cut in a length of 10 mm, the cut end surface was polished with an emery paper No. 600, and provided for a pitting test. The cut piece was immersed in a 6% aqueous solution of ferric chloride of 35 to 80° C., changed in temperature by 5° C. for 24 hours, and the highest temperature where no pitting is generated was measured. The measurement was performed by using five test pieces for one test tube, and the lowest value of them was taken as the critical pitting temperature and used as an indication of the pitting resistance.

As shown in Table 2, in even steels having the same composition, the pitting resistance is varied depending on the killing condition. Namely, in Inventive Examples 1 to 3 with a killing starting temperature of 1500° C. and a retained time of not less than 5 minutes, the number of oxide-based inclusions with a total content of Ca and Mg of 20 to 40% and a long diameter of not less than 7 μm was not more than 10 per 1 $mm^2$ of the cross section perpendicular to the working direction, and satisfactory pitting resistance could be obtained. Particularly, in Inventive Examples 1 and 2, extremely satisfactory pitting resistance at a critical pitting temperature of 80° C. was observed, since the condition that the number of oxide-based inclusions with a content of S of not less than 15% and a long diameter of not less than 1 μm was 10 per 1 $mm^2$ of the cross section perpendicular to the working direction is also satisfied.

On the other hand, in Comparative Examples 1 to 3 where one or both of the killing temperatures and the retained time are out of the ranges limited by the present invention, the number of coarse oxide-based inclusions was increased to deteriorate the pitting resistance.

Example 2

Each duplex stainless steel, having a composition shown in Tables 3 and 4 was melted in a 500 kg-induction melting furnace, transferred to an AOD furnace, and secondarily refined therein. At this time, the slag basicity in the reductive stage was variously changed. The slag and the molten steel were sampled after the end of reductive stage and just after the composition minute adjustment after reduction, respectively, and the composition-analyzed by chemical analysis. The temperature of the molten steel tapped to a ladle was immediately measured by a thermocouple, and the time to casting start was then measured.

TABLE 3

| Steel | Chemical composition (% by mass, Balance: Fe and impurities) | | | | | | | | | | | | | | | | |
|---|---|---|---|---|---|---|---|---|---|---|---|---|---|---|---|---|---|
| No. | C | Si | Mn | P | S | Ni | Cr | Mo | Al | N | O | Ca | Mg | Cu | B | W | ③ |
| 1 | 0.020 | 0.35 | 0.72 | 0.021 | 0.0004 | 4.54 | 22.50 | 3.18 | 0.007 | 0.145 | 0.0031 | 0.0022 | 0.0011 | — | — | — | 35.31 |
| 2 | 0.022 | 0.33 | 1.41 | 0.028 | 0.0002 | 4.89 | 23.12 | 3.22 | 0.012 | 0.158 | 0.0029 | 0.0005 | 0.0021 | 0.21 | — | — | 36.27 |
| 3 | 0.017 | 0.19 | 0.51 | 0.024 | 0.0004 | 4.58 | 22.89 | 3.17 | 0.009 | 0.175 | 0.0030 | 0.0011 | 0.0018 | — | 0.0027 | — | 36.15 |
| 4 | 0.018 | 0.39 | 0.56 | 0.005 | 0.0003 | 4.73 | 22.94 | 3.10 | 0.016 | 0.182 | 0.0028 | 0.0020 | 0.0004 | 0.52 | 0.0020 | — | 36.08 |
| 5 | 0.021 | 0.09 | 0.22 | 0.033 | 0.0006 | 4.31 | 22.85 | 2.86 | 0.023 | 0.151 | 0.0036 | 0.0019 | 0.0009 | — | — | — | 34.70 |
| 6 | 0.019 | 0.33 | 0.43 | 0.018 | 0.0006 | 4.61 | 22.64 | 3.08 | 0.026 | 0.120 | 0.0042 | 0.0018 | 0.0002 | 0.48 | — | — | 34.72 |
| 7 | 0.020 | 0.34 | 0.51 | 0.021 | 0.0007 | 4.69 | 22.81 | 3.12 | 0.039 | 0.138 | 0.0032 | 0.0005 | 0.0008 | — | 0.0019 | — | 35.31 |
| 8 | 0.018 | 0.41 | 0.55 | 0.039 | 0.0009 | 4.52 | 23.01 | 3.11 | 0.046 | 0.164 | 0.0031 | 0.0048 | 0.0004 | 0.51 | 0.0025 | — | 35.90 |
| 9 | 0.019 | 0.03 | 0.51 | 0.019 | 0.0003 | 6.66 | 27.11 | 3.14 | 0.022 | 0.381 | 0.0030 | 0.0019 | 0.0019 | 0.24 | 0.0019 | — | 43.57 |
| 10 | 0.022 | 0.31 | 0.53 | 0.021 | 0.0003 | 4.56 | 22.71 | 3.11 | 0.015 | 0.165 | 0.0031 | 0.0021 | 0.0017 | 0.20 | 0.0021 | 0.40 | 36.27 |
| 11 | 0.008 | 0.31 | 0.21 | 0.023 | 0.0002 | 6.71 | 25.31 | 3.08 | 0.018 | 0.311 | 0.0051 | 0.0022 | 0.0001 | — | — | 2.00 | 43.75 |
| 12 | 0.025 | 0.27 | 0.53 | 0.021 | 0.0003 | 6.60 | 25.50 | 3.18 | 0.007 | 0.291 | 0.0049 | 0.0021 | 0.0013 | 0.49 | — | 2.02 | 43.98 |
| 13 | 0.022 | 0.31 | 0.44 | 0.018 | 0.0003 | 6.67 | 25.81 | 2.86 | 0.014 | 0.281 | 0.0029 | 0.0019 | 0.0018 | — | 0.0018 | 2.23 | 43.42 |
| 14 | 0.018 | 0.43 | 0.21 | 0.014 | 0.0004 | 6.51 | 26.10 | 3.12 | 0.034 | 0.301 | 0.0028 | 0.0005 | 0.0011 | 0.82 | 0.0022 | 2.18 | 44.81 |
| 15 | 0.017 | 0.49 | 0.64 | 0.047 | 0.0009 | 6.97 | 25.51 | 3.12 | 0.038 | 0.321 | 0.0036 | 0.0022 | 0.0022 | — | — | 2.51 | 45.08 |
| 16 | 0.022 | 0.44 | 0.23 | 0.022 | 0.0008 | 6.78 | 25.11 | 3.09 | 0.022 | 0.313 | 0.0041 | 0.0023 | 0.0026 | 0.22 | — | 2.53 | 44.49 |
| 17 | 0.020 | 0.23 | 0.31 | 0.019 | 0.0007 | 6.85 | 25.36 | 3.46 | 0.009 | 0.324 | 0.0029 | 0.0019 | 0.0021 | — | 0.0017 | 2.31 | 45.77 |
| 18 | 0.009 | 0.29 | 0.34 | 0.009 | 0.0008 | 6.69 | 25.12 | 3.07 | 0.022 | 0.298 | 0.0030 | 0.0031 | 0.0023 | 0.51 | 0.0015 | 2.18 | 43.62 |
| 19 | 0.017 | 0.45 | 1.01 | 0.017 | 0.0003 | 10.71 | 30.51 | 3.01 | 0.017 | 0.321 | 0.0030 | 0.0022 | 0.0004 | — | — | 2.21 | 49.23 |
| 20 | 0.021 | 0.31 | 0.99 | 0.021 | 0.0004 | 11.98 | 31.94 | 3.13 | 0.022 | 0.318 | 0.0045 | 0.0021 | 0.0005 | — | — | 2.31 | 51.17 |
| 21 | 0.011 | 0.28 | 0.41 | 0.022 | 0.0003 | 4.61 | 22.81 | 3.06 | 0.019 | 0.151 | 0.0045 | 0.0043 | 0.0019 | — | — | — | 35.32 |
| 22 | 0.008 | 0.37 | 0.75 | 0.012 | 0.0004 | 4.63 | 23.01 | 2.51 | 0.018 | 0.132 | 0.0039 | 0.0045 | 0.0017 | 0.53 | — | — | 33.41 |
| 23 | 0.022 | 0.43 | 1.09 | 0.011 | 0.0003 | 4.45 | 23.11 | 3.21 | 0.023 | 0.148 | 0.0032 | 0.0027 | 0.0045 | — | 0.0020 | — | 36.07 |
| 24 | 0.013 | 0.91 | 0.29 | 0.022 | 0.0004 | 4.84 | 22.51 | 3.09 | 0.031 | 0.144 | 0.0041 | 0.0031 | 0.0048 | 0.51 | 0.0021 | — | 35.01 |
| 25 | 0.023 | 0.37 | 0.44 | 0.002 | 0.0002 | 6.69 | 23.50 | 2.96 | 0.019 | 0.344 | 0.0088 | 0.0022 | 0.0013 | — | — | — | 38.77 |

③: PREW(= Cr + 3.3(Mo + 0.5W) + 16N)

TABLE 4

| Steel No. | Chemical composition (% by mass, Balance: Fe and impurities) C | Si | Mn | P | S | Ni | Cr | Mo | Al |
|---|---|---|---|---|---|---|---|---|---|
| 26 | 0.024 | 0.18 | 0.51 | 0.022 | 0.0003 | 6.89 | 23.34 | 3.14 | 0.022 |
| 27 | 0.018 | 0.12 | 0.34 | 0.019 | 0.0004 | 6.74 | 23.31 | 2.87 | 0.036 |
| 28 | 0.022 | 0.43 | 0.39 | 0.030 | 0.0003 | 6.69 | 24.91 | 2.49 | 0.022 |
| 29 | 0.008 | 0.33 | 0.44 | 0.018 | 0.0006 | 6.69 | 25.01 | 3.18 | 0.024 |
| 30 | 0.007 | 0.21 | 0.23 | 0.012 | 0.0008 | 6.71 | 25.12 | 3.22 | 0.019 |
| 31 | 0.019 | 0.39 | 0.51 | 0.027 | 0.0007 | 7.01 | 25.34 | 3.08 | 0.017 |
| 32 | 0.020 | 0.31 | 0.53 | 0.020 | 0.0005 | 6.69 | 24.91 | 3.46 | 0.013 |
| 33 | 0.018 | 0.43 | 0.56 | 0.015 | 0.0007 | 6.98 | 25.10 | 3.09 | 0.014 |
| 34 | 0.020 | 0.44 | 0.41 | 0.017 | 0.0009 | 7.01 | 24.99 | 3.13 | 0.022 |
| 35 | 0.023 | 0.51 | 0.43 | 0.016 | 0.0008 | 6.74 | 25.08 | 3.51 | 0.025 |
| 36 | 0.017 | 0.50 | 0.41 | 0.020 | 0.0009 | 6.85 | 24.74 | 3.22 | 0.031 |
| 37 | 0.033* | 0.43 | 0.49 | 0.019 | 0.0005 | 1.00* | 25.11 | 3.21 | 0.015 |
| 38 | 0.022 | 2.52* | 0.44 | 0.016 | 0.0005 | 6.63 | 25.43 | 3.41 | 0.025 |
| 39 | 0.024 | 0.23 | 2.05* | 0.031 | 0.0003 | 6.87 | 26.01 | 3.08 | 0.029 |
| 40 | 0.021 | 0.36 | 0.54 | 0.052* | 0.0005 | 6.59 | 25.22 | 3.16 | 0.047 |
| 41 | 0.018 | 0.24 | 0.49 | 0.021 | 0.0012* | 6.53 | 26.41 | 3.09 | 0.036 |
| 42 | 0.010 | 0.22 | 0.43 | 0.018 | 0.0004 | 6.69 | 16.83* | 2.97 | 0.026 |
| 43 | 0.014 | 0.19 | 0.32 | 0.019 | 0.0003 | 6.81 | 25.54 | 0.11* | 0.034 |
| 44 | 0.013 | 0.23 | 0.31 | 0.021 | 0.0005 | 6.69 | 25.41 | 5.12* | 0.022 |
| 45 | 0.020 | 0.24 | 0.48 | 0.018 | 0.0005 | 6.38 | 25.61 | 3.05 | 0.052* |
| 46 | 0.019 | 0.21 | 0.45 | 0.033 | 0.0004 | 6.79 | 25.08 | 2.98 | 0.026 |
| 47 | 0.018 | 0.19 | 0.23 | 0.019 | 0.0003 | 7.03 | 24.98 | 3.06 | 0.031 |
| 48 | 0.021 | 0.24 | 0.17 | 0.020 | 0.0004 | 6.87 | 25.64 | 3.07 | 0.025 |

| Steel No. | Chemical composition (% by mass, Balance: Fe and impurities) N | O | Ca | Mg | Cu | B | W | ③ |
|---|---|---|---|---|---|---|---|---|
| 26 | 0.305 | 0.0076 | 0.0018 | 0.0016 | 0.50 | — | — | 38.58 |
| 27 | 0.312 | 0.0068 | 0.0016 | 0.0008 | — | 0.0019 | — | 37.77 |
| 28 | 0.326 | 0.0093 | 0.0008 | 0.0004 | 0.48 | 0.0018 | 2.11 | 41.82 |
| 29 | 0.330 | 0.0039 | 0.0045 | 0.0006 | 0.41 | 0.0022 | 2.12 | 44.28 |
| 30 | 0.308 | 0.0033 | 0.0024 | 0.0048 | 0.52 | 0.0012 | 2.35 | 44.55 |
| 31 | 0.317 | 0.0074 | 0.0025 | 0.0027 | 0.44 | 0.0023 | 2.24 | 44.27 |
| 32 | 0.305 | 0.0088 | 0.0029 | 0.0015 | 0.41 | 0.0019 | 2.09 | 44.66 |
| 33 | 0.312 | 0.0045 | 0.0041 | 0.0020 | 0.51 | 0.0021 | 2.11 | 43.77 |
| 34 | 0.345 | 0.0039 | 0.0046 | 0.0009 | 0.52 | 0.0013 | 2.23 | 44.52 |
| 35 | 0.311 | 0.0042 | 0.0012 | 0.0044 | 0.49 | 0.0017 | 2.09 | 45.09 |
| 36 | 0.309 | 0.0048 | 0.0022 | 0.0046 | 0.48 | 0.0020 | 2.07 | 43.73 |
| 37 | 0.316 | 0.0063 | 0.0031 | 0.0036 | 0.23 | 0.0021 | 2.11 | 44.24 |
| 38 | 0.322 | 0.0048 | 0.0022 | 0.0025 | 0.41 | 0.0019 | 2.09 | 45.28 |
| 39 | 0.314 | 0.0062 | 0.0033 | 0.0008 | 0.51 | 0.0017 | 1.91 | 44.35 |
| 40 | 0.380 | 0.0042 | 0.0041 | 0.0015 | 0.43 | 0.0009 | 2.22 | 45.39 |
| 41 | 0.304 | 0.0063 | 0.0013 | 0.0004 | 0.44 | 0.0021 | 2.24 | 45.17 |
| 42 | 0.312 | 0.0042 | 0.0018 | 0.0012 | 0.21 | 0.0017 | 2.20 | 35.25 |
| 43 | 0.312 | 0.0033 | 0.0022 | 0.0016 | 0.36 | 0.0013 | 2.08 | 34.33 |
| 44 | 0.306 | 0.0043 | 0.0022 | 0.0018 | 0.22 | 0.0010 | 1.98 | 50.47 |
| 45 | 0.309 | 0.0022 | 0.0036 | 0.0019 | 0.31 | 0.0014 | 2.20 | 44.25 |
| 46 | 0.041* | 0.0019 | 0.0019 | 0.0018 | 0.28 | 0.0015 | 2.24 | 39.91 |
| 47 | 0.312 | 0.0112* | 0.0009 | 0.0017 | 0.36 | 0.0019 | 2.12 | 43.57 |
| 48 | 0.307 | 0.0041 | 0.0018 | 0.0021 | 0.30 | 0.0021 | 4.08* | 47.42 |

③: PREW(= Cr + 3.3(Mo + 0.5W) + 16N)
*The chemical composition is out of the range limited by the present invention.

At this time, the ladle is stationarily stood and killed in a given position without producing vibration until it is lifted up by a ladle crane to start casting. The molten steel was casted to a steel ingot 160 mm on a side by average dimension, by bottom casting or to a round bloom 180 mm in outer diameter, by continuous casting. The resulting bloom was variously worked by forging, hot extrusion, or cold rolling and formed into a seamless steel pipe 16-280 mm in outer diameter and 1.4 to 16 mm in thickness. The resulting pipe was retained at 1100° C. for 3 minutes, and subjected to solution heat treatment by water-cooling. The slag basicity of the reductive stage, the killing condition and the total working ratio are shown in Tables 5 and 6.

After the above tube material was cut and flattened, two test pieces, having a dimension of pipe thickness ×10 mm×10 mm each, were cut out. The test pieces were mounted in a resin to the pipe cross-sectional direction, and this cross section was finished by polishing. Thereafter, the oxide-based inclusions of not less than 7 μm long diameter were observed by SEM for 5 field-of-views each at ×50 magnification, and the oxide-based inclusions of not less than 1 μm long diameter for 5 field-of-views each, at ×200 magnification. The long diameter of the oxide-based inclusions was measured according to the definition of FIG. 2, and the vicinity of the center part of each oxide-based inclusion (b1 or b2 in FIG. 2) was composition-analyzed by EDX (energy dispersive X-ray spectrometry). In the analysis, mass ratios of Al, Ca, Mg, S and Mn except O (oxygen) were measured because the measurement value of O (oxygen) is low in the reliability of precision. The result is also shown in Tables 5 and 6.

The tube material was sectionally cut in a length of 10 mm, the cut end surface was polished with an emery paper No. 600 and subjected to a pitting test. The cut piece was immersed in a 6% aqueous solution of ferric chloride of 35 to 80° C., changed in temperature by 5° C. for 24 hours, and the highest temperature where no pitting was generated, was measured. The measurement was performed by using five test pieces for one test tube, and the lowest value of them was taken as the critical pitting temperature and used as an indication of pitting resistance.

As the target value of pitting resistance, a critical pitting temperature of 35° C. is taken for general duplex stainless steel (steels No. 1 to 8, 10, 21 to 27, 42, 43 and 46 shown in Tables 3 and 4) with a pitting resistance index PRE (or PREW) of less than 40, and a critical pitting temperature of 70° C. for super duplex stainless steel (steels No. 9, 11 to 20, 28 to 41, 44, 45, 47 and 48 shown in Tables 3 and 4) with a pitting resistance index PRE (or PREW) of not less than 40. The result is also shown in Tables 5 and 6.

TABLE 5

| Classification | | Steel No. | Slag basicity in reduction | Frequency of desulfurization | Killing condition: Starting temperature (° C.) | Killing condition: Treatment time (min.) | Total working ratio | Number of oxide-based inclusions: ① (piece) | Number of oxide-based inclusions: ② (piece) | Critical pitting temperature (° C.) |
|---|---|---|---|---|---|---|---|---|---|---|
| Inventive Example | 4 | 1 | 2.5 | 2 | 1500 | 5 | 98 | 5.1 | 4.1 | 40 |
| | 5 | 2 | 1.5 | 2 | 1550 | 5 | 64 | 4.3 | 0 | 40 |
| | 6 | 3 | 2.0 | 2 | 1550 | 5 | 119 | 2.8 | 5.1 | 40 |
| | 7 | 4 | 1.2 | 2 | 1500 | 5 | 51 | 4.3 | 3.4 | 40 |
| | 8 | 5 | 0.5 | 2 | 1500 | 10 | 33 | 5.1 | 13.1** | 35 |
| | 9 | 6 | 2.0 | 1 | 1500 | 15 | 42 | 4.3 | 10.5** | 35 |
| | 10 | 7 | 2.2 | 1 | 1550 | 5 | 165 | 2.7 | 12.0** | 35 |
| | 11 | 8 | 2.0 | 1 | 1500 | 10 | 218 | 2.1 | 15.1** | 35 |
| | 12 | 9 | 1.0 | 2 | 1550 | 5 | 35 | 5.1 | 5.6 | 75 |
| | 13 | 10 | 2.3 | 2 | 1500 | 15 | 38 | 4.1 | 8.4 | 40 |
| | 14 | 11 | 3.0 | 1 | 1500 | 5 | 15 | 8.1 | 14.3** | 75 |
| | 15 | 12 | 1.6 | 2 | 1500 | 10 | 72 | 5.8 | 5.9 | 80 |
| | 16 | 13 | 1.0 | 2 | 1500 | 5 | 10 | 8.1 | 5.4 | 80 |
| | 17 | 14 | 2.4 | 2 | 1500 | 10 | 68 | 6.0 | 5.6 | 80 |
| | 18 | 15 | 1.8 | 2 | 1550 | 10 | 320 | 0.2 | 8.0 | 80 |
| | 19 | 16 | 2.4 | 1 | 1500 | 10 | 23 | 7.0 | 13.4** | 75 |
| | 20 | 17 | 2.0 | 1 | 1550 | 5 | 146 | 2.5 | 12.0** | 75 |
| | 21 | 18 | 1.8 | 1 | 1500 | 10 | 105 | 6.1 | 13.1** | 75 |
| | 22 | 19 | 2.5 | 2 | 1500 | 5 | 50 | 3.4 | 3.1 | 80 |
| | 23 | 20 | 2.0 | 2 | 1550 | 5 | 120 | 4.2 | 4.2 | 80 |
| Comparative Example | 4 | 21 | 3.1 | 2 | 1500 | 5 | 33 | 12.3* | 1.4 | 25 |
| | 5 | 22 | 3.2 | 1 | 1500 | 5 | 64 | 13.0* | 3.2 | 25 |
| | 6 | 23 | 2.0 | 2 | 1450 | 10 | 48 | 10.5* | 1.9 | 30 |
| | 7 | 24 | 2.2 | 1 | 1500 | 3 | 35 | 13.9* | 4.1 | 30 |
| | 8 | 25 | 2.3 | 1 | 1500 | 5 | 8 | 12.7* | 5.0 | 25 |

① The number of oxide-based inclusions which have a total content of Ca and Mg of 20-40% and also have a long diameter of not less than 7 μm per 1 $mm^2$ of the cross section perpendicular to the working direction.
② The number of oxide-based inclusions which have a contain of S of not less than 15% and also have a long diameter of not less than 1 μm per 0.1 $mm^2$ of the cross section perpendicular to the working direction.
*The number in ① is out of the range limited by the present invention.
**The number in ② is out of the range limited by the present invention.

TABLE 6

| Classification | | Steel No. | Slag basicity in reduction | Frequency of desulfurization | Killing condition: Starting temperature (° C.) | Killing condition: Treatment time (min.) | Total working ratio | Number of oxide-based inclusions: ① (piece) | Number of oxide-based inclusions: ② (piece) | Critical pitting temperature (° C.) |
|---|---|---|---|---|---|---|---|---|---|---|
| Comparative Example | 9 | 26 | 3.0 | 2 | 1500 | 5 | 7 | 11.5* | 2.3 | 30 |
| | 10 | 27 | 1.8 | 1 | 1500 | 5 | 8 | 10.9* | 7.4 | 25 |
| | 11 | 28 | 3.2 | 1 | 1500 | 5 | 68 | 15.1* | 4.9 | 60 |
| | 12 | 29 | 0.3 | 1 | 1500 | 5 | 45 | 12.4* | 14.1** | 60 |
| | 13 | 30 | 3.1 | 1 | 1500 | 5 | 33 | 14.3* | 11.9** | 55 |
| | 14 | 31 | 2.0 | 1 | 1450 | 5 | 45 | 11.9* | 13.7** | 50 |
| | 15 | 32 | 1.5 | 1 | 1450 | 10 | 65 | 18.4* | 13.1** | 55 |
| | 16 | 33 | 2.0 | 1 | 1500 | 3 | 77 | 12.5* | 11.0** | 60 |
| | 17 | 34 | 0.4 | 1 | 1500 | 5 | 105 | 12.0* | 15.1** | 60 |
| | 18 | 35 | 2.0 | 1 | 1500 | 5 | 8 | 11.4* | 12.0** | 55 |
| | 19 | 36 | 1.5 | 1 | 1500 | 5 | 5 | 13.0* | 15.6** | 60 |
| | 20 | 37# | 2.2 | 1 | 1550 | 5 | 32 | 3.1 | 5.1 | 65 |
| | 21 | 38# | 1.8 | 2 | 1500 | 10 | 103 | 3.7 | 3.5 | 65 |
| | 22 | 39# | 1.2 | 1 | 1500 | 5 | 218 | 1.9 | 6.1 | 65 |
| | 23 | 40# | 2.5 | 1 | 1550 | 5 | 105 | 5.1 | 7.0 | 45 |

TABLE 6-continued

| Classification | Steel No. | Slag basicity in reduction | Frequency of desulfurization | Killing condition: Starting temperature (° C.) | Killing condition: Treatment time (min.) | Total working ratio | Number of oxide-based inclusions: ① (piece) | Number of oxide-based inclusions: ② (piece) | Critical pitting temperature (° C.) |
|---|---|---|---|---|---|---|---|---|---|
| 24 | 41# | 2.4 | 2 | 1500 | 10 | 55 | 5.6 | 21.9** | 45 |
| 25 | 42# | 1.4 | 1 | 1550 | 5 | 35 | 3.1 | 4.1 | 30 |
| 26 | 43# | 2.4 | 1 | 1500 | 10 | 28 | 4.3 | 5.3 | 30 |
| 27 | 44# | 1.0 | 1 | 1500 | 5 | 55 | 6.9 | 7.4 | 55 |
| 28 | 45# | 1.5 | 1 | 1500 | 10 | 68 | 6.1 | 2.9 | 65 |
| 29 | 46# | 1.0 | 1 | 1500 | 5 | 97 | 4.7 | 5.2 | 60 |
| 30 | 47# | 1.6 | 1 | 1550 | 5 | 68 | 23.1* | 7.6 | 60 |
| 31 | 48# | 1.3 | 1 | 1500 | 15 | 46 | 5.0 | 8.1 | 65 |

① The number of oxide-based inclusions which have a total content of Ca and Mg of 20-40% and also have a long diameter of not less than 7 μm per 1 $mm^2$ of the cross section perpendicular to the working direction.
② The number of oxide-based inclusions which have a contain of S of not less than 15% and also have a long diameter of not less than 1 μm per 0.1 $mm^2$ of the cross section perpendicular to the working direction.
#The chemical composition is out of the range limited by the present invention.
*The number in ① is out of the range limited by the present invention.
**The number in ② is out of the range limited by the present invention.

In Inventive Examples 4 to 23, the chemical composition and the number of oxide-based inclusions with a total content of Ca and Mg of 20 to 40% and a long diameter of not less than 7 μm were within the ranges limited by the present invention. Therefore, excellent pitting resistance equal to or more than the above-mentioned target value can be obtained in both the general stainless steels and the super stainless steels. Particularly, in Inventive Examples 4 to 7, 12, 13, 15 to 18, 22 and 23 where the number of oxide-based inclusions with a content of S of not less than 15% and a long diameter of not less than 1 μm, was not more than 10 per 0.1 $mm^2$ of the cross section perpendicular to the working direction, excellent pitting resistance was obtained in both the general stainless steels and the super stainless steels.

On the other hand, in Comparative Examples 20 to 31 where the chemical composition was out of the range limited by the present invention, sufficient anti-corrosion performance as duplex stainless steel could not be ensured. In Comparative Examples 4 to 19 where steels have chemical compositions within the range limited by the present invention, but production conditions are not proper, pitting resistance is not good because a large quantity of oxide-based inclusions harmful to pitting remained.

According to the present invention, duplex stainless steel, having satisfactory pitting resistance, can be stably obtained. Therefore, duplex stainless steel, most suitable for steel pipes, steel plates or the like such as piping for heat exchange, piping or structures for chemical plant, line pipes, oil well or gas well casing or tubing, or umbilical tubes (control piping of submarine oil field) can be provided.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The invention claimed is:

1. A duplex stainless steel containing, by mass %, C: not more than 0.03%, Si: 0.01 to 2%, Mn: 0.1 to 2%, P: not more than 0.05%, S: not more than 0.001%, Al: 0.003 to 0.05%, Ni: 4 to 12%, Cr: 18 to 32%, Mo: 0.2 to 5%, N (nitrogen): 0.05 to 0.4%, O (oxygen): not more than 0.01%, Ca: 0.0005 to 0.005%, Mg: 0.0001 to 0.005%, Cu: 0 to 2%, B: 0 to 0.01%, and W: 0 to 4%, and the balance of Fe impurities, where a number of oxide-based inclusions, which have a total content of Ca and Mg of 20 to 40% by mass and also have a long diameter of not less than 7 μm, is not more than a 10 per 1 $mm^2$ of the cross section perpendicular to the working direction, wherein a pitting resistance index PREW represented by the following equation (1) is not less than 40:

$$PREW=Cr+3.3(Mo+0.5W)+16N \quad (1)$$

wherein each chemical symbol represents the content of each element (% by mass).

2. A duplex stainless steel containing, by mass %, C: not more than 0.03%, Si: 0.01 to 2%, Mn: 0.1 to 2%, P: not more than 0.05%, S: not more than 0.001%, Al: 0.003 to 0.05%, Ni: 4 to 12%, Cr: 18 to 32%, Mo: 0.2 to 5%, N (nitrogen): 0.05 to 0.4%, O (oxygen): not more than 0.01%, Ca: 0.0005 to 0.005%, Mg: 0.0001 to 0.005%, Cu: 0 to 2%, B: 0 to 0.01%, and W: 0 to 4%, and the balance of Fe and impurities, where a number of oxide-based inclusions, which have a total content of Ca and Mg of 20 to 40% by mass and also have a long diameter of not less than 7 μm, is not more than a 10 per 1 $mm^2$ of the cross section perpendicular to the working direction, and a number of oxide-based inclusions, which have a content of S of not less than 15% by mass and also have a long diameter of not less than 1 μm, is not more than 10 per 0.1 $mm^2$ of the cross section perpendicular to the working direction, wherein a pitting resistance index PREW represented by the followina equation (1) is not less than 40;

$$PREW=Cr+3.3(Mo+0.5W)+16N \quad (1)$$

wherein each chemical symbol represents the content of each element (% by mass).

3. The duplex stainless steel according to claim 1, further containing 0.2 to 2% of Cu by mass.

4. The duplex stainless steel according to claim 1, further containing 0,001 to 0.01% of B by mass.

5. The duplex stainless steel according to claim 1, further containing 0.1 to 4% of W by mass.

6. A method for producing a duplex stainless steel, according to claim 1, characterized by treating stainless steel alloy in molten state to a reductive treatment carried out in a condition providing a slag basicity represented by the following equation (2) is 0.5 to 3.0, killing to tapped molten steel at the temperature not lower than 1500° C. for not less than 5 minutes followed by casting, and fanning the resulting bloom on the condition that the total working ratio R, represented by the following equation (3), is not less than 10;

$$[\text{Slag Basicity}] = (CaO + MgO)/(Al_2O_3 + SiO_2) \quad (2)$$

$$[\text{Total working ratio } R] = \prod_{n=1}^{i}\left(\frac{A0_n}{A_n}\right) \quad (3)$$

wherein each compound in the equation (2) represents the concentration in slag of each compound (% by mass), $A0_n$ and $A_n$ in the equation (3) represent a cross-sectional area before deformation in a plastic deformation process and a cross-sectional area after deformation in the plastic deformation process, respectively, and each subscript n (1, 2, . . . i) represents each stand order in the plastic deformation process.

7. The duplex stainless steel according to claim 2, further containing 0.2 to 2% of Cu by mass.

8. The duplex stainless steel according to claim 2, further containing 0.001 to 0.0 1% of B by mass.

9. The duplex stainless steel according to claim 3, further containing 0.001 to 0.01% of B by mass.

10. The duplex stainless steel according to claim 2, further containing 0.1 to 4% of W by mass.

11. The duplex stainless steel according to claim 3, further containing 0.1 to 4% of W by mass.

12. The duplex stainless steel according to claim 4, further containing 0.1 to 4% of W by mass.

13. A method for producing a duplex stainless steel, according to claim 2, characterized by treating stainless steel alloy in molten state to a reductive treatment carried out in a condition providing a slag basicity represented by the following equation (2) is 0.5 to 3.0, killing to tapped molten steel at the temperature not lower than 1500° C. for not less than 5 minutes followed by casting, and forming the resulting bloom on the condition that the total working ratio R, represented by the following equation (3), is not less than 10;

$$[\text{Slag Basicity}] = (CaO + MgO)/(Al_2O_3 + SiO_2) \quad (2)$$

$$[\text{Total working ratio } R] = \prod_{n=1}^{i}\left(\frac{A0_n}{A_n}\right) \quad (3)$$

wherein each compound in the equation (2) represents the concentration in slag of each compound (% by mass), $A0_n$ and $A_n$ in the equation (3) represent a cross-sectional area before deformation in a plastic deformation process and a cross-sectional area after deformation in the plastic deformation process, respectively, and each subscript n (1, 2, . . . i) represents each stand order in the plastic deformation process.

14. A method for producing a duplex stainless steel, according to claim 3, characterized by treating stainless steel alloy in molten state to a reductive treatment carried out in a condition providing a slag basicity represented by the following equation (2) is 0.5 to 3.0, killing to tapped molten steel at the temperature not lower than 1500° C. for not less than 5 minutes followed by casting, and forming the resulting bloom on the condition that the total working ratio R, represented by the following equation (3), is not less than 10;

$$[\text{Slag Basicity}] = (CaO + MgO)/(Al_2O_3 + SiO_2) \quad (2)$$

$$[\text{Total working ratio } R] = \prod_{n=1}^{i}\left(\frac{A0_n}{A_n}\right) \quad (3)$$

wherein each compound in the equation (2) represents the concentration in slag of each compound (% by mass), $A0_n$ and $A_n$ in the equation (3) represent a cross-sectional area before deformation in a plastic deformation process and a cross-sectional area after deformation in the plastic deformation process, respectively, and each subscript n (1, 2, . . . i) represents each stand order in the plastic deformation process.

15. A method for producing a duplex stainless steel, according to claim 4, characterized by treating stainless steel alloy in molten state to a reductive treatment carried out in a condition providing a slag basicity represented by the following equation (2) is 0.5 to 3.0, killing to tapped molten steel at the temperature not lower than 1500° C. for not less than 5 minutes followed by casting, and forming the resuldng bloom on the condition that the total working ratio R, represented by the following equation (3), is not less than 10;

$$[\text{Slag Basicity}] = (CaO + MgO)/(Al_2O_3 + SiO_2) \quad (2)$$

$$[\text{Total working ratio } R] = \prod_{n=1}^{i}\left(\frac{A0_n}{A_n}\right) \quad (3)$$

wherein each compound in the equation (2) represents the concentration in slag of each compound (% by mass), $A0_n$ and $A_n$ in, the equation (3) represent a cross-sectional area before deformation in a plastic deformation process and a cross-sectional area after deformation in the plastic deformation process, respectively, and each subscript n (1, 2, . . . i) represents each stand order in the plastic defonnation process.

16. A method for producing a duplex stainless steel, according to claim 5, characterized by treating stainless steel alloy in molten state to a reductive treatment carried out in a condition providing a slag basicity represented by the following equation (2) is 0.5 to 3.0, killing to tapped molten steel at the temperature not lower than 1500° C. for not less than 5 minutes followed by casting, and forming the resulting bloom on the condition that the total working ratio R, represented by the following equation (3), is not less than 10;

$$[\text{Slag Basicity}] = (CaO + MgO)/(Al_2O_3 + SiO_2) \quad (2)$$

$$[\text{Total working ratio } R] = \prod_{n=1}^{i}\left(\frac{A0_n}{A_n}\right) \quad (3)$$

wherein each compound in the equation (2) represents the concentration in slag of each compound (% by mass), $A0_n$ and $A_n$ in the equation (3) represent a cross-sectional area before deformation in a plastic deformation process and a cross-sectional area after deformation in the plastic deformation process. respectively, and each subscript n (1, 2, . . . i) represents each stand order in the plastic deformation process.

17. The duplex stainless steel according to claim 9, further containing 0.1 to 4% of W by mass.

* * * * *

UNITED STATES PATENT AND TRADEMARK OFFICE

CERTIFICATE OF CORRECTION

PATENT NO. : 7,396,421 B2
APPLICATION NO. : 11/135448
DATED : July 8, 2008
INVENTOR(S) : Omura et al.

It is certified that error appears in the above-identified patent and that said Letters Patent is hereby corrected as shown below:

Column 17, line 66:
"and W: 0 to 4%, and the balance of Fe impurities, where a" should read:
"and W: 0 to 4%, and the balance of Fe and impurities, where a"

Column 18, line 67:
"minutes followed by casting, and fanning the resulting bloom" should read:
"minutes followed by casting, and forming the resulting bloom"

Signed and Sealed this

Second Day of December, 2008

JON W. DUDAS
*Director of the United States Patent and Trademark Office*